United States Patent [19]

Earhart et al.

[11] Patent Number: 4,713,119

[45] Date of Patent: Dec. 15, 1987

[54] PROCESS FOR REMOVING ALKALI METAL ALUMINUM SILICATE SCALE DEPOSITS FROM SURFACES OF CHEMICAL PROCESS EQUIPMENT

[75] Inventors: Jonathan P. Earhart, Orinda; John A. Kostecki, Pinole, both of Calif.; Adrian C. McNutt, Rock Springs, Wyo.

[73] Assignee: Stauffer Chemical Company, Westport, Conn.

[21] Appl. No.: 841,989

[22] Filed: Mar. 20, 1986

[51] Int. Cl.[4] ..... C23G 1/02; B08B 9/00; B08B 30/00

[52] U.S. Cl. ..... 134/3; 134/22.13; 134/22.17; 134/28; 134/29

[58] Field of Search ..... 134/3, 22.13, 22.17, 134/28, 29

[56] References Cited

U.S. PATENT DOCUMENTS

| | | | |
|---|---|---|---|
| 1,279,331 | 9/1918 | Gravell | 134/28 X |
| 3,166,444 | 1/1965 | Ehren et al. | 134/3 |
| 3,499,793 | 3/1970 | Petitjean et al. | 134/22.17 X |
| 3,520,813 | 7/1970 | Hansen et al. | 134/3 X |
| 3,522,093 | 7/1970 | Woolman | 134/22.17 X |
| 3,582,402 | 6/1971 | Wisla | 134/3 |
| 3,625,761 | 12/1971 | Tate | 134/3 |
| 3,639,278 | 2/1972 | Hwa | 134/3 X |
| 4,116,714 | 9/1978 | Basi | 134/29 X |
| 4,374,101 | 2/1983 | Lussiez et al. | 134/3 X |
| 4,389,254 | 6/1983 | Tusset et al. | 134/3 |
| 4,485,027 | 11/1984 | Rossmann et al. | 134/29 X |

FOREIGN PATENT DOCUMENTS

| | | | |
|---|---|---|---|
| 542748 | 6/1957 | Canada | 134/28 |
| 47-29205 | 8/1972 | Japan | 134/3 |
| 54-150326 | 11/1979 | Japan | 134/3 |
| 386263 | 1/1933 | United Kingdom | 134/3 |
| 152603 | 4/1963 | U.S.S.R. | |

OTHER PUBLICATIONS

Diagnosing Evaporator Performance; Seavoy, Swenson Evaporator Co. (C.P.A.A. Annual Meeting, 1944).

*Primary Examiner*—Andrew H. Metz
*Assistant Examiner*—William G. Wright
*Attorney, Agent, or Firm*—Joel G. Ackerman

[57] ABSTRACT

Alkali metal aluminum silicate scale deposits are removed from surfaces of chemical processing equipment by alternating treatments with acidic and basic solutions, with optional rinsing of the equipment between treatments.

15 Claims, No Drawings

PROCESS FOR REMOVING ALKALI METAL ALUMINUM SILICATE SCALE DEPOSITS FROM SURFACES OF CHEMICAL PROCESS EQUIPMENT

A common problem in chemical processing equipment, particularly shell-and-tube-heat exchangers and other tubular chemical process equipment, is the formation of scale deposits, which must be removed from time to time for the equipment to properly function. One particular type of scale deposit which is difficult to remove is scale containing alkali metal aluminum silicates, such as sodium or potassium aluminum silicate. Such deposits form from the passage of alumina- and silica-containing materials in various fluids passing through the equipment. Build-up of scale can interfere with the proper operation of such equipment, for instance, by reducing the heat transfer coefficient between a fluid and the surface of a tube.

Various methods are known in the art for removing alkali metal aluminum silicate scale deposits from equipment surfaces. One technique is the treatment of the equipment with a 20% solution of sodium bisulfate followed by draining the solution and contacting the scale with steam. The sodium bisulfate is considered to react with the scale to form a silicic acid while dissolving aluminum-containing substances of the silicate. The silicic acid which deposits on the tube surface is removed by treatment with steam to dehydrate the acid, followed by mechanical removal. These steps are repeated as frequently as required in order to clean the equipment. Other known techniques include the use of concentrated nitric acid and dilute sulfurous acid.

SUMMARY OF THE INVENTION

This invention comprises a process for the removal of alkali metal aluminum silicate scale deposits from surfaces of chemical process equipment comprising the steps of:

(a) contacting the scale deposit with an aqueous acidic solution containing sulfuric acid, sodium bisulfate, tartaric acid, or phosphoric acid, the concentration of acid in said solution being from about 0.1 to about 5M, to dissolve alumina-containing material from the deposit;

(b) removing the acidic stream from contact with the scale deposit;

(c) thereafter dissolving silicic acid from the scale deposit by contacting the scale deposit with an aqueous basic solution having a concentration of from about 0.5 to about 10M of a basic material which is sufficiently basic to dissolve silicic acid;

(d) removing the basic solution from contact with the scale deposit; and (e) repeating steps (a) through (d) until the scale deposit is substantially removed.

DETAILED DESCRIPTION OF THE INVENTION

This invention pertains to the removal of alkali metal aluminum silicate scale deposits from surfaces of chemical processing equipment, particularly tubular equipment such as various types of heat exchangers, including shell-and-tube heat exchangers, plate-and-frame exchangers, evaporators, reboilers, process heaters, waste heat boilers, and other similarly structured equipment. This equipment is also applicable to the removal of scale deposits from other types of equipment, such as vessels, reactors, and particularly equipment jackets such as reactor jackets and heat exchanger shells. For convenience, however, this description of the invention will be phrased primarily in terms of removing deposits from tubular equipment. The presence of scale deposits on either the interior or exterior surfaces of tubes can interfere with the heat transfer function of such equipment, reducing the heat transfer coefficient between a fluid and the tube surface.

Alkali metal aluminum silicate scale deposits form on such tubes from the presence of such materials in fluids passing through or around the tubes. In general, such deposits will contain silica, alumina, and sodium or potassium oxide, in varying proportions. The most common scales of this type are sodium aluminum silicates, one example being analcite, which is particularly difficult to remove. Potassium and other alkali metal aluminum silicate scales may also form in tubes, depending on the composition of materials passing through or around the tubes in various chemical processes.

According to the present invention, such scale deposits are removed by contacting them alternately with acidic and basic solutions, with draining off or removal of the solutions between treatments.

The acidic solutions suitable for use in this invention contain sulfuric acid, sodium bisulfate, tartaric acid and/or phosphoric acid, with sulfuric acid being preferred. The concentration of the acid in the aqueous stream can be relatively dilute or relatively concentrated. For practical purposes, the concentration of the acid would vary from about 0.1 to about 5M, preferably from about 0.1 to about 2M, most preferably from about 0.5 to about 2M. A 1M solution is considered convenient for use in this invention. The acidic solution may also contain a corrosion inhibitor according to the usual practice in the industry. The particular corrosion inhibitor, and the amount used, will depend on the acid employed and the composition of the tubes.

The temperature of the acid treatment step will also generally be dependent on the presence and type of a corrosion inhibitor. This temperature is set according to normal practice and the recommendation of the supplier of the corrosion inhibitor and will generally be in the range of about 100°-200° F. (37.75°-93.33° C.). The pressure is not a factor in this operation; any convenient pressure can be employed.

The dissolution of the alkali metal aluminum silicate scale is believed to take place in two distinct steps. The acid treatment is considered to dissolve the alumina or aluminum-containing portion of the scale. At the same time, the silica or silicate portion is believed to be converted to a form of silicic acid which is gelatinous and tends to form or accumulate on the scale surface. At some point this deposit would cover the scale surface and prevent the dissolution of further alumina.

The aluminum component of the dissolved alumina or other aluminum-containing material from the deposit is considered to be present in the acidic solution primarily or wholly in the form of $Al^{+++}$ ion. The dissolution of aluminum-containing material can be followed by analysis of acidic solution samples removed from the equipment at appropriate intervals, for instance by atomic absorption analysis. At some point the formed silicic acid would cover most or all of the scale surface and essentially prevent or substantially diminish further dissolution of alumina. This event will be reflected in that analyses of the acidic sample will show little or no increase in aluminum content.

In a preferred embodiment therefore, the first step of the present process, namely the treatment with acidic solution, is carried out until the concentration of aluminum in the acidic solution has reached an approximately constant value. At this point the acidic solution can no longer be effective. Consequently, this step of the process is then completed, and the acidic solution is removed from contact with the scale deposit by draining or otherwise removing it from the equipment being treated.

Alternatively, the treatment with acidic solution can be terminated earlier, when the dissolution of alumina is less than complete.

In the next step of the process, the deposit is contacted with a basic solution which has a concentration of from about 0.5 to about 10M of a suitable base. The base utilized is an inorganic base which is a stronger base than sodium silicate, that is, it is sufficiently strong to dissolve redeposited silicic acid (without reprecipitation of sodium silicate). Suitable bases include sodium and potassium hydroxides and carbonates, or mixtures thereof, including soda ash. A preferred concentration of the basic material in the solution would vary from one base to another, but is generally in the range of about 0.5 to 10M, preferably about 0.5 to about 6M, conveniently about 1M. The temperature of treatment with the basic solution is in the range of about 100°-200° F. (37.75°-93.33° C.).

The basic solution is considered to function by reacting with the silicic acid gel deposit and dissolving silica. The basic solution treatment is therefore carried out until the gelatinous layer which had previously formed is dissolved. This can be determined by tracking the concentration of silicon (present as one or another form of silicate anion) in the basic solution, for instance by atomic absorption analyses. When this concentration reaches a constant value, little or no further silicic acid gel is being dissolved and the basic solution has essentially accomplished its purpose. The silicic acid gel having been removed, there is now a fresh surface of alkali metal aluminum silicate scale available for treatment by the acidic solution, and the basic solution is then removed from contact with the deposit, and the deposit again contacted with an acidic solution as in the first step. The alternating treatment of the deposit by acidic and basic solutions is continued until the scale is effectively removed. This is easily demonstrated when an acidic solution introduced into the equipment is shown to dissolve little or no alumina. At this point, one further basic solution treatment is applied to dissolve whatever silicic acid might remain, and the tube is then essentially clean of the deposit.

As an optional feature, the tubes may be rinsed with water between acid and base, and base and acid treatments, respectively. Such a rinse removes residual acidic or basic solution as well as some additional dissolved alumina or silica from the apparatus and can also carry away dislodged solid flakes of silica.

The contacting with the acidic or basic solutions, or with the rinse water, can be effected in any of several convenient ways. Preferably, the solution or rinse water is introduced into the apparatus to be cleaned in such a manner as to permit the apparatus to be filled with the liquid. At this point, the solution or rinse water may be permitted to stand in the apparatus and then eventually be drained off, or may be circulated and recirculated through the apparatus until the treatment step is ended. In the treatment of non-tubular equipment, some agitation may be applied. Storage facilities, pumps, valves and piping for carrying out the process are conventional and are made of such material as necessary to withstand corrosion from the acidic or basic solutions to be employed.

While it is possible to use freshly prepared acidic or basic solutions each time the steps are repeated, this is not necessary. Since the dissolution of alumina or silica into the acidic or basic solutions, respectively, does not necessarily proceed to saturation, the solutions may be reused until saturated as the steps are repeated. Alternatively, if several pieces of equipment are to be cleaned, acidic and basic solutions, as well as rinse water, can be cycled from one piece of apparatus to another. Appropriate acid and base may be added between steps to restore depleted material or increase the solution concentration, if desired. In some situations, depending on the composition of the scale and the concentrations and types of materials in the acidic and basic solutions, the ability of either solution to dissolve silica may be a limiting factor on the process. Should the capacity of either solution for dissolving silica be fulfilled before the scale is completely removed, fresh solution should be substituted for the recycle. When acidic and/or basic solutions are depleted, they are neutralized, or may be used to neutralize each other, and appropriately disposed of as waste. Apparatus and equipment for recirculating solutions or cycling them from one piece of apparatus to be cleaned to another are appropriately constructed, as known in the art, of materials designed to resist corrosion.

The invention is further illustrated by the following examples.

EXAMPLE I

This example demonstrates a cleaning operation carried out on a heat exchanger in a plant for refining of trona ore to produce soda ash.

Two shell-and-tube heat exchangers having a total of more than 1000 tubes, constructed of 316 L stainless steel, which had analcite scale deposits, were cleaned by alternate treatment with 9% (by weight) sulfuric acid solution for 2 hours and 20% (by weight) caustic solution for 2 hours. Two cycles of treatment at 160° F., followed by water hydroblast produced bare metal over about 95% of the inner surface of the tubes, as determined by visual inspection.

A comparative cleaning conducted using 20% caustic solution at the same temperature was carried out for 29 hours and was also effective in dissolving most of the scale, but the rate of dissolution was much slower.

An additional comparative treatment using 20% sodium bisulfate solution (by weight) for 4 hours at 160° F., followed by heating with steam and then hydroblasting, was less effective.

EXAMPLE II

This example demonstrates the use of fresh and reused acid and basic solutions and also demonstrates the use of a basic solution containing sodium hydroxide.

Samples of analcite scale obtained from heat exchangers in the plant described in Example I were used in this and the following examples. The scale samples had the overall composition:

| Element Analyzed for | Assumed Oxide | Wt % Oxide |
|---|---|---|
| Si | $SiO_2$ | 50–61 |
| Al | $Al_2O_3$ | 18–21 |
| Na | $Na_2O$ | 12–14 |
| Fe | $Fe_2O_3$ | 0–1 |
| K | $K_2O$ | 0–0.1 |
| — | $H_2O$ | 4–18* |

*by difference.

Three 10-ml stainless steel beakers were charged with (respectively) 100 ml of 9% sulfuric acid containing a corrosion inhibitor (Rodine 31A), 100 ml of 14.7% (by weight) caustic solution and 100 ml rinse water. The beakers were covered and kept in an oven set at 160° F. (71.11° C.). About 5 grams of scale in small pieces was placed in a basket and the initial weight of the scale measured. The basket and scale were immersed in the acid beaker for abut one hour, then in the rinse water beaker for 5 minutes, then in the caustic beaker for 15 minutes, and finally again in the rinse water beaker for 5 minutes, in all cases without agitation. After each immersion, 5 ml samples were collected from the acid and caustic beakers and were analyzed by atomic absorption for dissolved silica and alumina. This cycle was repeated, for a total of 8 cycles, with analysis being conducted after each cycle of treatment. The results are given in the following Table I. The values in this and subsequent tables represent aluminum and silicon content (determined by atomic absorption spectra) in terms of equivalent alumina and silica, respectively. This experiment demonstrates that both acid and caustic solutions can be reused, with effective dissolution of scale.

TABLE I

Analcite Dissolving Test - Both Acid and Caustic Reused

Each Cycle Included the following at 160° F.:
1. Scale soaked for 1 hour in the same 9% $H_2SO_4$.
2. Scale soaked for 5 minutes in same rinse water.
3. Scale soaked for 15 minutes in same 14.7% NaOH.
4. Scale soaked for 5 minutes in same rinse water.

| After | In $H_2SO_4$ | | In NaOH | |
|---|---|---|---|---|
| Cycle No. | ppm $SiO_2$ | ppm $Al_2O_3$ | ppm $SiO_2$ | ppm $Al_2O_3$ |
| 1 | 260 | 1,020 | 2,100 | 40 |
| 2 | 380 | 2,300 | 4,200 | 80 |
| 3 | 570 | 3,000 | 6,600 | 150 |
| 4 | 530 | 5,300 | 8,600 | 190 |
| 5 | 1,100 | 7,000 | 11,500 | (300)* |
| 6 | 1,200 | 8,100 | 12,600 | 400 |
| 7 | 1,800 | 5,900 | 12,200 | (800)* |
| 8 | 2,600 | 6,200 | 12,800 | 1,200 |

After 8 cycles, the rinse water contained 5,300 ppm $SiO_2$ and 620 ppm $Al_2O_3$.
*Estimated value; insufficient sample for analysis.

EXAMPLE III

This example demonstrates the use of fresh acid with reused base and also demonstrates the use of a basic solution containing sodium carbonate.

The procedure followed was that of Example II, except that after each cycle a fresh sample of 9% by weight sulfuric acid solution was placed in the acid beaker. Subsequent to cycle No. 6, the caustic solution was replaced by 30% (by weight) sodium carbonate solution. The results are given in Table III.

TABLE III

Analcite Dissolving Test - Fresh Acid - Base Reused

First 6 Cycles Included the following at 160° F.:
1. Scale soaked for 1 hour in fresh 9% $H_2SO_4$.
2. Scale soaked for 5 minutes in same rinse water.
3. Scale soaked for 15 minutes in same 14.7% NaOH.
4. Scale soaked for 5 minutes in same rinse water.

For Cycles 7 and 8, Step 3 replaced by the following at 160° F.
3. Scale soaked for 15 minutes in same 30% $Na_2CO_3$.

| After | In $H_2SO_4$ | | | |
|---|---|---|---|---|
| Cycle No. | ppm $SiO_2$ | ppm $Al_2O_3$ | ppm $SiO_2$ | ppm $Al_2O_3$ |
| | | | In NaOH | |
| 1 | (260)* | 2,860 | 9,800 | 80 |
| 2 | (230)* | 2,100 | 14,100 | 150 |
| 3 | 210 | 1,100 | 14,100 | 150 |
| 4 | 240 | 810 | 15,000 | 250 |
| 5 | 150 | 640 | 14,100 | 230 |
| 6 | 230 | 260 | 13,900 | 380 |
| | | | In $Na_2CO_3$ | |
| 7 | 300 | 530 | — | — |
| 8 | 510 | 340 | 1,150 | <20 |

After 8 cycles, the rinse water contained 6,600 ppm $SiO_2$ and 130 ppm $Al_2O_3$.
*Estimated value.

EXAMPLE IV

This example demonstrates the use of soda ash (sodium carbonate) plus some sodium bicarbonate as the component of a basic solution.

The procedure that was followed was essentially that of Example II, with the following changes. The acid beaker was replaced for each cycle by fresh 9% by weight sulfuric acid solution. The basic solution contained 28% by weight sodium carbonate and 0.5% by weight sodium bicarbonate. The soaking time for the basic solution was as indicated.

The results of this experiment are shown in Table IV.

TABLE IV

Analcite Dissolving Test - Fresh Acid - $Na_2CO_3$ Reused

Each Cycle Included the Following at 160° F.:
1. Scale soaked for 1 hour in fresh 9% $H_2SO_4$.
2. Scale soaked for 5 minutes in same rinse water.
3. Scale soaked in same 28% $Na_2CO_3$ + 0.5% $NaHCO_3$.
4. Scale soaked for 5 minutes in same rinse water.

| After Cycle | In $H_2SO_4$ | | In $Na_2CO_3$ + $NaHCO_3$ | | |
|---|---|---|---|---|---|
| No. | ppm $SiO_2$ | ppm $Al_2O_3$ | ppm $SiO_2$ | ppm $Al_2O_3$ | Minutes |
| | | | 920 | <10 | 15 |
| 1 | 130 | 1080 | 1,400 | <10 | 30 |
| | | | 1,700 | <10 | 60 |
| 2 | 90 | 740 | 2,100 | <10 | 30 |
| 3 | 90 | 570 | 2,800 | <10 | 30 |
| 4 | 90 | 430 | 3,200 | <10 | 30 |
| 5 | 170 | 340 | 3,800 | 20 | 30 |
| 6 | 90 | 320 | 2,800 | 10 | 30 |
| 7 | 260 | 400 | 3,000 | <10 | 30 |
| 8 | 130 | 250 | 3,200 | 20 | 30 |

After 8 cycles, rinse water contained 1,100 ppm $SiO_2$ and 20 ppm $Al_2O_3$.

EXAMPLE V

This example demonstrates the use of other acids in the process.

Samples (100 ml of each) of test acid solutions were heated to about 70° C. in a stirred beaker. After collection of an initial sample of acid, 1.2 g of powdered analcite scale was added. Samples of acid were removed from the beakers at intervals of 15 minutes, 2 hours, 5 hours and 24 hours, filtered to remove undissolved scale, and analyzed for silica and alumina content (a sample for phosphoric acid was only analyzed at the 24-hour period). The results are shown in the following Table V.

TABLE V

| | (Dissolved Silica and Alumina Expressed as mg/liter) | | | | | | | |
|---|---|---|---|---|---|---|---|---|
| | Soak Time | | | | | | | |
| | 15 Minutes | | 2 Hours | | 5 Hours | | 24 Hours | |
| Acid/wt. % | Sil. | Alum. | Sil. | Alum. | Sil. | Alum. | Sil. | Alum. |
| sulfuric (9.3) | 380 | 1900 | 270 | 2750 | 240 | 2800 | 190 | 2800 |
| $NaHSO_4$ (20.0) | 280 | 1380 | 260 | 1510 | 260 | 1870 | 210 | 2460 |
| tartaric (13.6) | 130 | 340 | 210 | 720 | 380 | 1450 | 260 | 2080 |
| phosphoric (9.3) | — | — | — | — | — | — | 260 | 1500 |

As shown in Table V, the sulfuric acid solution reached a peak alumina dissolution at about 5 hours. The sodium bisulfate and tartartic acid solutions had not reached their peak of dissolution at this point, although they had attained the majority of alumina dissolution at this point. Similarly, by the 5 hour interval, the dissolution of silica by both sulfuric acid and sodium bisulfate had dropped off. This indicates that a 24 hour period soak time is not necessary for these acidic solutions.

What is claimed is:

1. A process for the removal of alkali metal aluminum silicate scale deposits from surfaces of chemical process equipment comprising the steps of:

(a) contacting the scale deposit with an aqueous acidic solution containing sulfuric acid, sodium bisulfate, tartaric acid, or phosphoric acid, the concentration of acid in said solution being from about 0.1 to about 2M, to dissolve aluminum-containing material from the deposit;

(b) removing the acidic stream from contact with the scale deposit;

(c) thereafter dissolving silicic acid from the scale deposit by contacting the scale deposit with an aqueous basic solution having a concentration of from about 0.5 to about 10M of a material which is sufficiently basic to dissolve silicic acid;

(d) removing the basic solution from contact with the scale deposit; and (e) repeating steps (a) through (d) until the scale deposit is substantially removed.

2. A process according to claim 1 in which steps (a) through (d) are repeated at least once and fresh acidic solution is used in each repetition of step (a).

3. A process according to claim 1 in which steps (a) through (d) are repeated at least once and fresh basic solution is used in each repetition of step (c).

4. A process according to claim 1 further comprising rinsing unremoved acidic solution from the equipment with water between steps (b) and (c).

5. A process according to claim 1 further comprising rinsing unremoved basic solution from the equipment with water between step (d) and a repetition of step (a).

6. A process according to claim 1 in which the acidic solution used in step (a) has a concentration from about 0.5 to about 5M.

7. A process according to claim 1 in which the acidic solution used in step (a) has a concentration of from about 0.5 to about 2M.

8. A process according to claim 1 in which the acidic solution used in step (a) has a concentration of about 1M.

9. A process according to claim 1 in which the acidic solution comprises sulfuric acid.

10. A process according to claim 1 in which the basic solution comprises sodium hydroxide.

11. A process according to claim 1 in which the basic solution comprises sodium carbonate.

12. A process according to claim 1 in which the basic solution has a concentration of from about 0.5 to about 6M.

13. A process according to claim 1 in which step (a) is conducted until the concentration of aluminum in the acidic solution reaches a substantially constant value.

14. A process according to claim 1 in which step (c) is conducted until the concentration of silicon in the basic solution reaches a substantially constant value.

15. A process according to claim 1 in which the chemical process equipment has tubular surfaces.

* * * * *